US005853624A

United States Patent [19]

Raghu et al.

[11] Patent Number: 5,853,624

[45] Date of Patent: Dec. 29, 1998

[54] FLUIDIC SPRAY NOZZLES FOR USE IN COOLING TOWERS AND THE LIKE

[75] Inventors: Surya Raghu, Columbia; Ronald D. Stouffer, Silver Spring, both of Md.

[73] Assignee: Bowles Fluidics Corporation, Columbia, Md.

[21] Appl. No.: 798,685

[22] Filed: Feb. 12, 1997

[51] Int. Cl.[6] ..... B01F 3/04

[52] U.S. Cl. ..... 261/81; 261/111; 239/589.1

[58] Field of Search ..... 261/81, 111; 239/589.1

[56] References Cited

U.S. PATENT DOCUMENTS

| | | | |
|---|---|---|---|
| Re. 33,605 | 6/1991 | Bauer | 239/589.1 |
| 2,775,310 | 12/1956 | Shelton | 261/111 |
| 4,111,366 | 9/1978 | DeWitte . | |
| 4,151,955 | 5/1979 | Stouffer . | |
| 4,320,072 | 3/1982 | Arndt . | |
| 4,390,478 | 6/1983 | Sheperd . | |
| 4,568,022 | 2/1986 | Scrivner . | |
| 4,662,568 | 5/1987 | Bauer | 239/589.1 |
| 4,700,893 | 10/1987 | Bugler, III . | |
| 5,129,585 | 7/1992 | Bauer | 239/589.1 |
| 5,242,110 | 9/1993 | Riley | 239/589.1 |

*Primary Examiner*—Tim R. Miles
*Attorney, Agent, or Firm*—Jim Zegeer, Esq.

[57] ABSTRACT

A cooling tower having a housing for forming droplets of hot water in an air stream which causes a small portion of the hot water issuing from said oscillating spray nozzles to evaporate and remove heat from the remaining water thereby cooling said remaining water. A sump collects the remaining water and returns the remaining water to the heat source. The low pressure fluidic oscillating nozzles: (a) form large sized droplets of hot water uniformly over a large area, (b) reduce the quantity of droplets of hot water that are less than 2 mm diameter, (c) issue a spray pattern that reduces aerodynamic interference with air flow from said air blower, and (d) reduce sediments getting into the spraying of said hot water. In a preferred embodiment, the fluidic oscillator is a cusped island oscillator having an outlet with diverging sidewalls.

11 Claims, 3 Drawing Sheets

FLUIDIC SPRAY NOZZLES FOR USE IN COOLING TOWERS AND THE LIKE

The present invention relates to an improved fluidic nozzle for use in cooling towers. Cooling towers are used for cooling liquids, usually water, which is used in the manufacturing plant or other facility for cooling equipment. In a typical cooling tower, water from a heat source is distributed over a wet deck surface through a large orifice spray nozzle. Simultaneously, air is blown upward over the wet deck surface causing a small portion of water to evaporate. This operation removes heat from the remaining water. The cooled water is collected in a tower sump and returned to the heat source.

There have been many efforts in the past to devise nozzles for use in cooling towers with reference being made to DeWitte U.S. Pat. No. 4,111,366, Bugler, III U.S. Pat. No. 4,700,893, Scrivnor U.S. Pat. No. 4,568,022, Arndt U.S. Pat. No. 4,320,072 and Sheperd U.S. Pat. No. 4,390,478 as typical examples. Typically, these nozzles use a surface, frequently curved, to deflect or disperse water discharged thereon. In DeWitte, a spinner defines a plurality of arms projecting from a central section with each arm being spaced from an adjacent arm by grooves or slots with certain inclination angles to the arms with respect to the travel direction of liquid passing out of an orifice. In Bugler, III, the target is situated below an outlet and has an essentially conical ramp-like element which first is impacted by the water, and then a plurality of transversely arcuate water-dispersing fingers oriented in a circular array around the base of the ramp. Hot water is passed downwardly through the conduct for impingement on the target structure and attempts to create a relatively even dispersal of water over a large area beneath the target. Scrivnor discloses a spray nozzle which includes a cylindrical member and a baffle and a concavely curved dispersal member which distributes or discharges the water in a circular spray pattern onto a bank of tubes or cooling tower fill. In Arndt, nozzles with curved deflectors are on the sides of the assembly and prevent liquid from being sprayed out or on top on to the tower. In Sheperd, a central aperture is formed in a dispersion plate leading to a conical dispersion element which has raised projections on the surface for breaking the liquid up into droplets.

According to the present invention, a low-pressure fluidic nozzle is comprised of an island member in an oscillation chamber with the island member having an upstream surface and alternate vortex shedding sides and a hot-water inlet for introducing hot water from a manifold into the oscillation chamber and directing the water against the upstream island surface. The oscillation chamber has lateral sidewalls which are cusped and which then diverge from the cusps in a downstream direction to provide a diverging hot-water outlet without impinging on any surfaces downstream of the outlet. The system of alternating shed vortices in conjunction with lateral sidewalls results in a waving sheet of heated water which breaks up into water droplets which have predominant size range larger than about 3.25 mm. The fluidic oscillator of the present invention provides for forming large size droplets of hot water uniformly distributed over a large area, reducing the quantity of droplets of hot water that are less than 2 mm diameter (3.75 mm is preferred), and issuing a spray pattern that reduces an aerodynamic interference with air flow from the blower and, finally, reduces sediments getting into the spraying of the hot water.

BRIEF DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
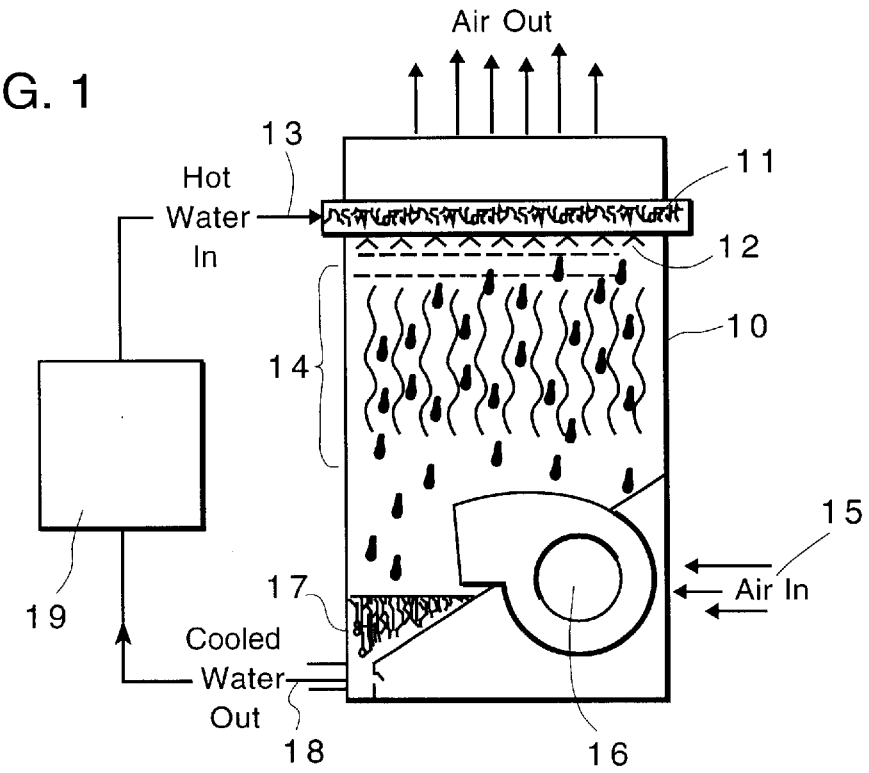
FIG. 1 is a schematic diagram of a cooling tower of the evaporative type.

Referring to FIG. 1, in a typical evaporative-type cooling tower, a housing 10 contains a series of headers 11 having an array of nozzles 12 for issuing or spraying hot water from a source 13 onto a wet deck surface 14 through spray nozzles 12. Simultaneously, external air 15 is blown by blower 16 upwards over the wet deck 14 causing a small portion of water to evaporate. This evaporation removes heat from the remaining water. The cool water is collected in the tower sump 17 and returned by a pump (not shown) to each source 18.

Figure 2:
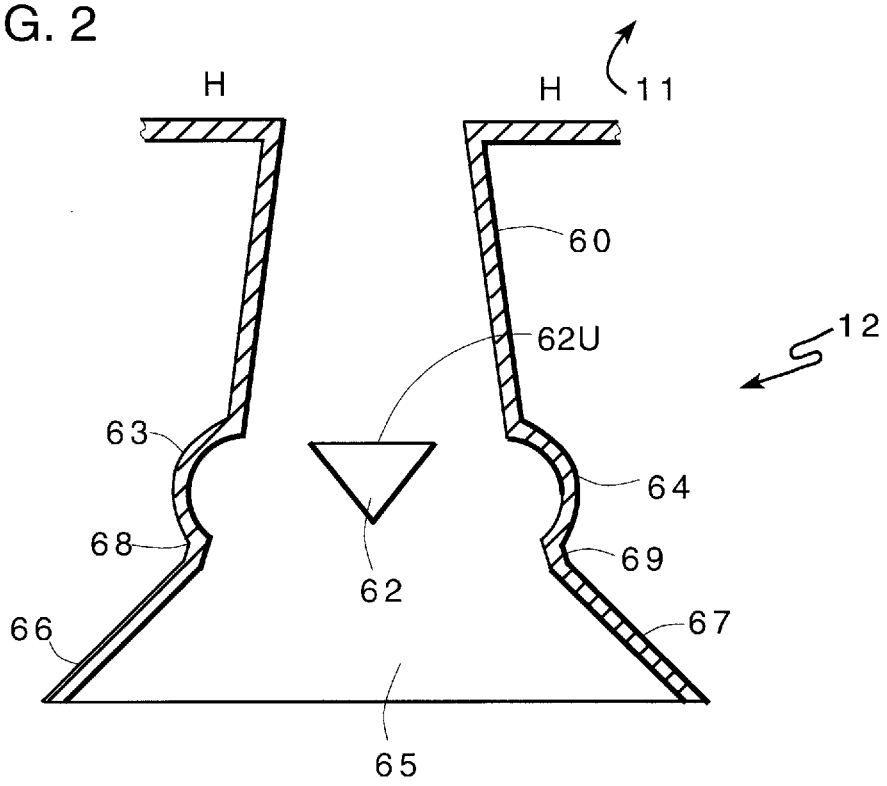
FIG. 2 is a diagram of a fluidic oscillator of the island-type disclosing the preferred embodiment for use in the present invention.

According to the present invention, a large volume fluidic nozzle for cooling towers is utilized to obtain large size droplets and large area spreading of the water within 8 to 12 inches and a large volume flow nozzle (10 to 100 gallons per minute). In addition, the present invention minimizes air flow deflection due to the nozzle flow and eliminates clogging of nozzles by small openings, calcification, etc. by providing an oscillatory fluid flow. According to the invention, the spray nozzles incorporates a large island oscillator which can deliver 10 to 100 gallons per minute flow rate of water and can be mounted on a manifold to produce the required spread or coverage. A preferred embodiment of the fluidic nozzle is illustrated in FIG. 2. As shown in FIG. 2, the fluidic oscillator is of an island type having an input section 60 which is adapted to be coupled or connected to a hot-water manifold or header H (FIG. 3) along with a plurality of similar fluidic oscillator nozzle units. While in a preferred embodiment each of the units are of the same size, it is clear that they need not all be of the same size. Some may be of different size ranges to give full coverage of a given wet deck size or area.

Cusps 63, 64 are provided on each side of triangle-shaped island 62 so that the oscillator may be designated a cusped triangle island oscillator. The outlet region 65 is bounded by a pair of diverging walls 66, 67 which are coupled by a short neck region 68, 69 to the cusps 63, 64, respectively. In operation, hot water from the header H is introduced into the inlet region 60 and the hot water impinges on the upstream wall 62U of island 60. As the water passes the obstruction surface 62, it divides and produces shed vortices which in turn produce first and second fluid pulse trains at opposite sides of the island 62 producing first and second fluid pulses of varying amplitude and different phases. In effect, the triangular island 62 and cusps 63, 64 define a pair of vortex-controlled, sediment-free hot-liquid flow passages. These shed vortices are formed at the opposite ends of triangular island 62 and are oppositely rotating resulting in a sheet of liquid which is oscillated back and forth to form droplets with substantially no droplets smaller than about 3.75 mm. Droplets smaller than this have higher drag coefficients and can become airborne. The sheet has its length dimension in the plane perpendicular to the plane of the drawing and, due to the shed vortices is oscillated back and forth in the plane of the drawing as indicated in the drawings.

Figure 3:
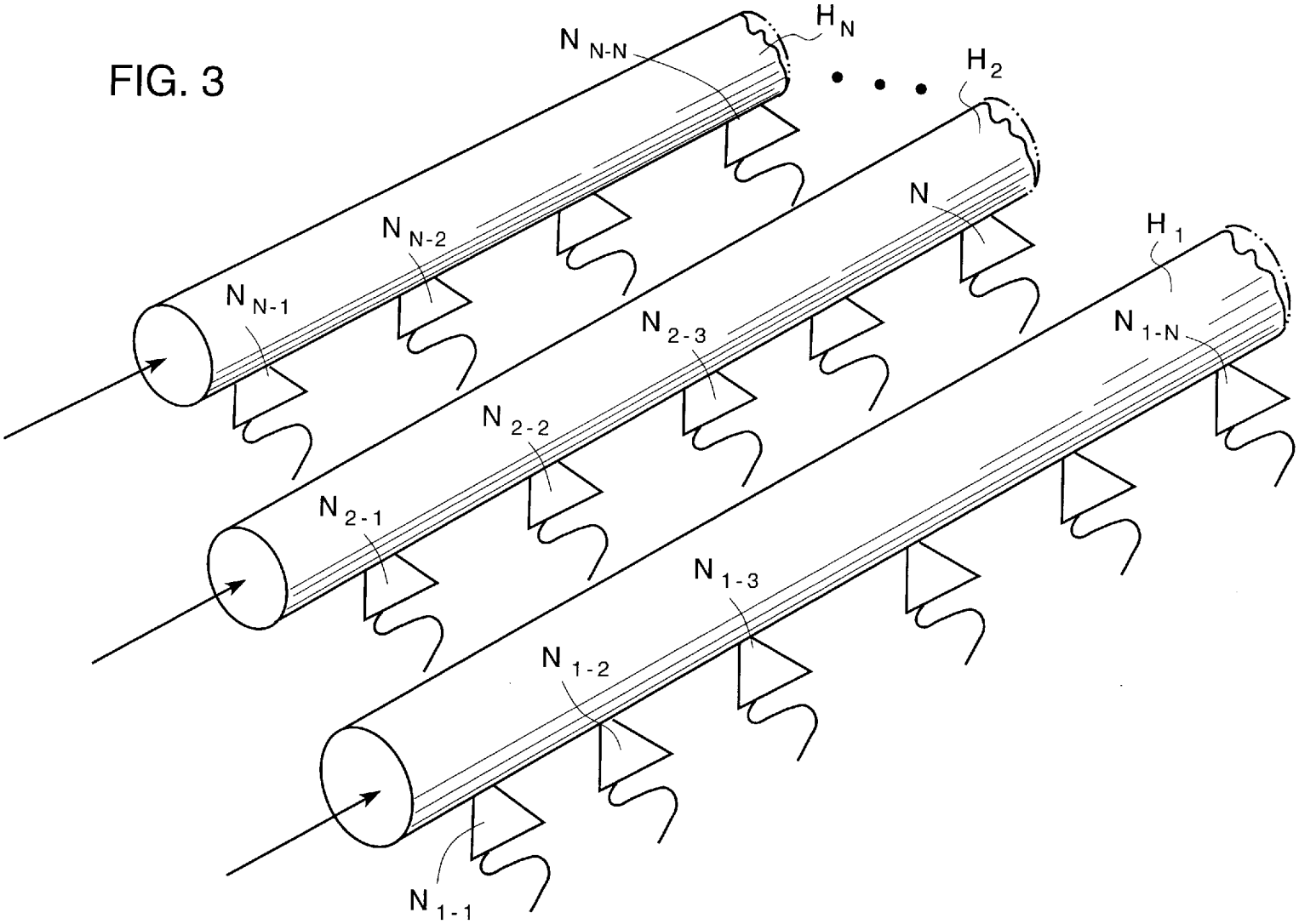
FIG. 3 is an isometric diagram of a typical header with nozzles incorporating the circuit as shown in FIG. 3 and the type of spray emanating from the nozzles.

As shown in FIG. 3, the nozzles are arrayed in a matrix so that at the lateral ends of the sweep and edges of the sweep path there is little overlap of hot water droplets. Thus, the fluid forces generated by the alternating pulsating vortices causes the formation of the sheet or the sweeping thereof back and forth to form droplets.

Each header H1, H2 . . . HN has a predetermined number of nozzles in N1-1, N1-2, N1-3, N1-4 . . . N1-N; N2-1, N2-3, N2-4 . . . N2-N; NN-1, NN-2, NN-3 . . . NN-N. Each nozzle is adapted to accommodate a set area of the wet deck surface. As indicated in connection with FIG. 1, simultaneously, air is blown upward over the wet deck surface causing a small portion of the water to evaporate and the evaporation removes the heat from the remaining water. The cool water is collected in the lower sump and returned to the heat source for reuse.

Figure 4A:
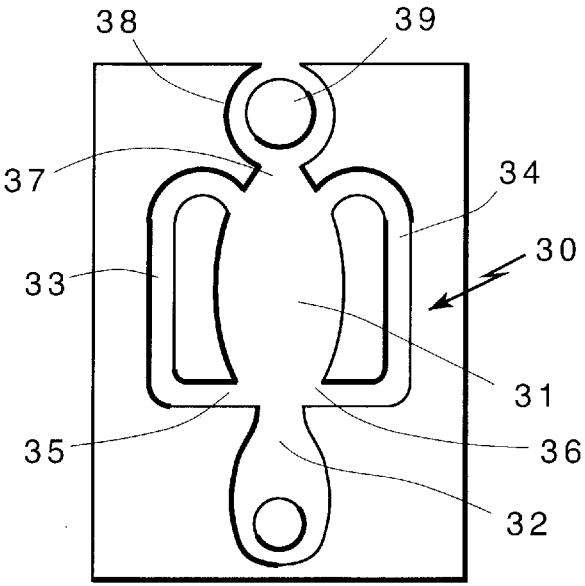
FIG. 4A is a illustration of a fluidic nozzle with an island end outlet for issuing full coverage spray.

Referring now to FIG. 4A, which discloses an oscillator of the type shown in FIG. 20 of Stouffer U.S. Pat. No. 4,151,955, the nozzles employs a circular island 39 in the outlet region in conjunction with a conventional fluidic oscillator 31. The fluidic oscillator 30 has an interaction region 31 which receives a jet of hot water from power nozzle 32. A pair of feedback passages 33, 34 are disposed to receive fluid at opposite sides of the downstream end of the interaction region and feed control fluid back to control ports 35, 36. The sides of the interaction region converge beyond the feedback passage to form an outlet throat 37, and an outlet region 38 extends from the throat 37. The outlet region 38 is configured generally circular so as to be substantially concentric about a circular island 39. The effect of the island in the oscillator is to convert the fluidic swept jet to a swept sheet.

Figure 4B:
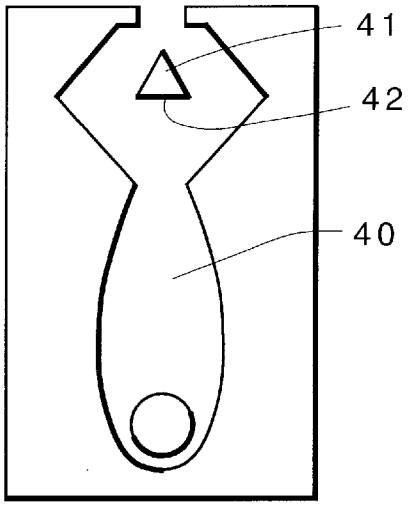
FIG. 4B is a full coverage island oscillator circuit for use in a cooling tower.

In FIG. 4B, a power nozzle 40 issues a jet of hot water against the upstream end 42 of island 41. The liquid divides and flows to one side or the other of the island 41, and the shed vortex sheet causes the hot water stream to cyclically oscillate and then issue as a sheet through the outlet in a waving pattern.

Figure 4C:
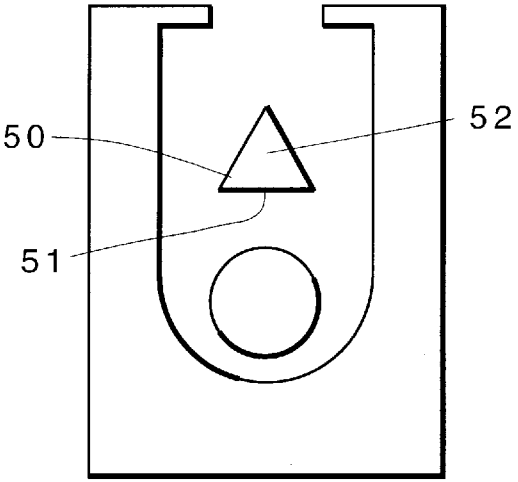
FIG. 4C is another diagrammatic illustration of an island oscillator for issuing a full coverage of spray.

In the embodiment shown in FIG. 4C, fluid is introduced into the upstream end of the island oscillator 50 and impinges on the upstream end 51 of island 52. The fluid divides and part flows to the left side of the island and part flows to the right side of island 52. Alternately rotating shed vortices are formed on opposite sides of the island and cause the hot water to issue from the chamber in a form of a sheet which is cyclically swept back and forth in a direction transverse to the flow direction of a sheet. The sweep device is island 52 for forming the alternately rotating shed vortices which act on the fluid and tend to cause it to issue from the chamber in a swept sheet. The swept sheet breaks up into small particles which are dispersed over a two-dimensional area of the wet deck disposed in the flow path of the swept sheet.

While the present invention has been illustrated and described in its preferred form, it will be appreciated and understood that various modifications, adaptations and other variations may be made therein without departing from the scope of the invention as set forth in the appended claims.

What is claimed is:

1. In a cooling tower having a housing, a wet deck, a manifold for receiving hot water from a heat source, a plurality of hot-water spray nozzles mounted on said manifold for spraying said hot water on said wet deck, air blower means for blowing air over said wet deck and causing a small portion of said hot water issuing from said spray nozzles to evaporate and remove heat from the remaining water thereby cooling said remaining water by evaporation, and a sump means for collecting said remaining water and returning said remaining water to said heat source, the improvement wherein said spray nozzles include a low pressure fluidic oscillator for: (a) forming large sized droplets of hot water uniformly over a large area, (b) reducing the quantity of droplets of hot water that are less than 2 mm diameter, (c) issuing a spray pattern that reduces aerodynamic interference with air flow from said air blower, and (d) reduces sediments getting into the spraying of said hot water.

2. The cooling tower defined in claim 1 wherein said fluidic oscillator is dimensioned so that the bulk of said droplets of hot water are greater than about 3.75 mm in diameter.

3. The cooling tower defined in claim 1 wherein said fluidic oscillator is an island oscillator having an oscillation chamber, an island member in said oscillation chamber, said island member having an upstream surface and a pair of alternate vortex shedding edges, a hot-water inlet means for introducing hot water from said manifold into said oscillation chamber and directing said hot water against said upstream surface, said oscillation chamber having a pair of lateral sidewalls which define to a hot-water outlet and, with said island member, define a pair of vortex-controlled sediment-free hot-liquid flow passages.

4. The cooling tower defined in claim 3, said upstream surface having a center and wherein said hot-water inlet means includes a power nozzle having sidewalls converging to a power nozzle outlet, said power nozzle outlet being coaxially aligned with the center of said upstream surface.

5. The cooling tower defined in claim 3 wherein each one of said pair of lateral sidewalls include a cusp proximate said island member and a pair of diverting wall members downstream of said cusps.

6. The cooling tower defined in claim 5 wherein said hot-water inlet includes a power nozzle having diverging sidewalls.

7. The cooling tower defined in claim 5 wherein said sidewalls converge to define said hot-water outlet.

8. The cooling tower defined in claim 7, said upstream surface having a center and wherein said hot-water inlet includes a power nozzle having sidewalls diverging toward said island member, said power nozzle outlet being coaxially aligned with the center of said upstream surface.

9. The cooling tower defined in claim 8 wherein said fluidic oscillator is dimensioned so that the bulk of said droplets of hot water are greater than about 3.75 mm in diameter.

10. In a cooling tower having a housing, a manifold for receiving hot water from a heat source, a plurality of hot-water spray nozzles mounted on said manifold for spraying said hot water in said housing, air blower means for blowing air in a predetermined direction in said housing and causing a small portion of said hot water issuing from said spray nozzles to evaporate and remove heat from the remaining water by evaporation thereby cooling said remaining water, and a sump means in said housing for collecting said remaining water cooled by said evaporation and returning said remaining water to said heat source, the improvement wherein said spray nozzles include a low-pressure cusped island oscillator for issuing a sheet of liquid and causing said sheet to: (a) form large sized droplets of hot water uniformly over a large area, (b) reduce the quantity of droplets of hot water that are less than 2 mm diameter, (c) issue a spray pattern that reduces aerodynamic interference with air flow from said air blower, and (d) reduces sediments getting into the spraying of said hot water.

11. The cooling tower defined in claim 10 wherein said island oscillator has an oscillation chamber, an island member in said oscillation chamber, said island member having an upstream surface and a pair of alternate vortex shedding edges, a hot-water inlet means for introducing hot water from said manifold into said oscillation chamber and directing said hot water against said upstream surface, said oscillation chamber having lateral sidewalls which form a hot-water outlet and, with said island member, define a pair of vortex-controlled sediment-free hot-liquid flow passages.

* * * * *